United States Patent [19]

Ashton

[11] 3,964,602

[45] June 22, 1976

[54] MULTI-PURPOSE RECEPTACLE

[75] Inventor: Harold P. Ashton, Providence, R.I.

[73] Assignee: Dart Industries Inc., Los Angeles, Calif.

[22] Filed: Aug. 5, 1974

[21] Appl. No.: 494,671

[52] U.S. Cl. ..... 206/75; D7/73; 229/2.5 R

[51] Int. Cl.[2] ..... B65D 1/34

[58] Field of Search ..... D7/37, 73; 206/72, 75, 206/372; 211/60 R, 60 T; 229/2.5; 248/37.3

[56] References Cited

UNITED STATES PATENTS

| | | | |
|---|---|---|---|
| 2,311,332 | 2/1943 | Fleischner | 206/75 UX |
| 3,181,698 | 5/1965 | Knapp et al. | 229/2.5 X |
| D48,039 | 10/1915 | Niper | D7/73 |
| D156,958 | 1/1950 | Hoeft | D7/73 |
| D166,849 | 5/1952 | Candee | D7/73 |
| D177,478 | 4/1956 | Marchion | D7/73 |
| D192,230 | 2/1962 | Zucca | D7/73 |

*Primary Examiner*—Steven E. Lipman
*Attorney, Agent, or Firm*—Leigh B. Taylor; Paul R. Wylie; Kenneth J. Hovet

[57] ABSTRACT

A multi-purpose receptacle to support various culinary implements and having interrelated supporting surfaces of varying configurations to retain such implements.

6 Claims, 6 Drawing Figures

MULTI-PURPOSE RECEPTACLE

This invention relates to receptacles for spoons, ladles, forks and similar utensils used for culinary purposes. More particularly, the invention encompasses a unique arrangement for such receptacles in that it occupies a minimum of space and yet affords the user a device that will accommodate the aforementioned implements in a stable and readily accessible position.

Prior art receptacles that are intended for similar usage have been of a box type configuration and of a size that somewhat restricted the user's effective placement thereof. Furthermore, these devices have characteristically included numerous individual retention means of various sizes based upon the various sizes of impelements employed in culinary processing. This, accordingly, increased the size of the receptacle and in many instances, a substantial portion of such receptacle was not used during the culinary process.

This invention incorporates into a small and compact unit a design or structural configuration that overcomes these prior objectionable features. Additionally, the invention has as a primary objective the inclusion of a minimum of retention means for typical culinary implements, each such retention means being suitable for supporting any one of a number of such implements. Likewise, it is an objective to provide a conveniently arranged tray which will protect the surrounding supporting surface therefor and also retain culinary implements such as spoons, ladles, knives, forks, spatulas or the like in a position convenient for the user to again grasp same.

These and other objectives of the invention will become more apparent with continued reference to the following specification and accompanying drawings wherein.

Figure 2:
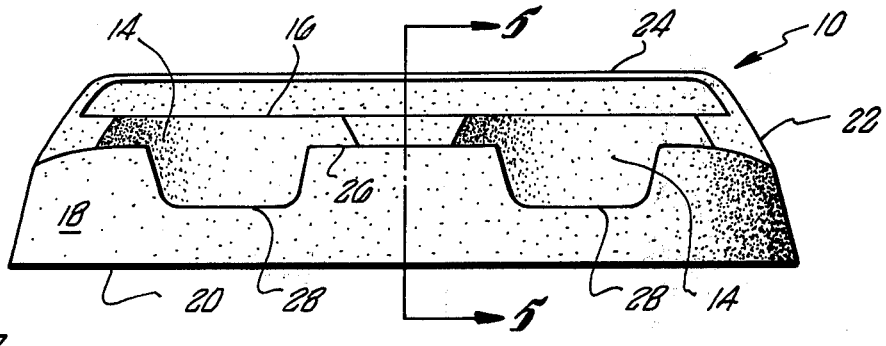
FIG. 2 is a front elevational view of the mentioned receptacle more clearly illustrating the retentive means for various culinary implements.
Figure 5:
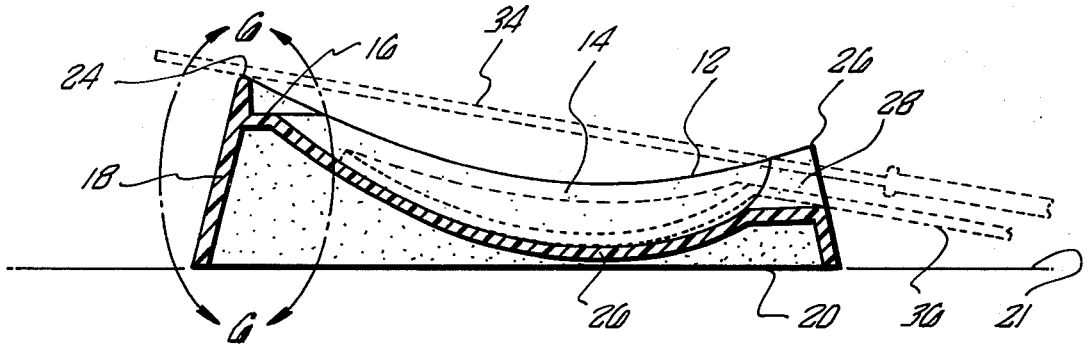
Figure 6:
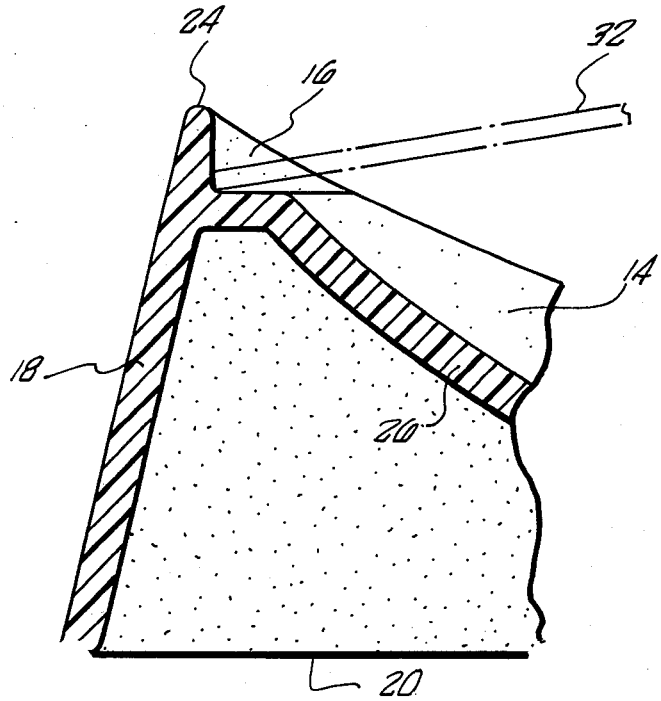

FIG. 5 similarly is a cross-sectional view of the receptacle taken along line 5—5 of FIG. 2;

FIG. 6 is an enlarged cross-sectional view taken along line 6—6 of FIG. 5.

Figure 1:
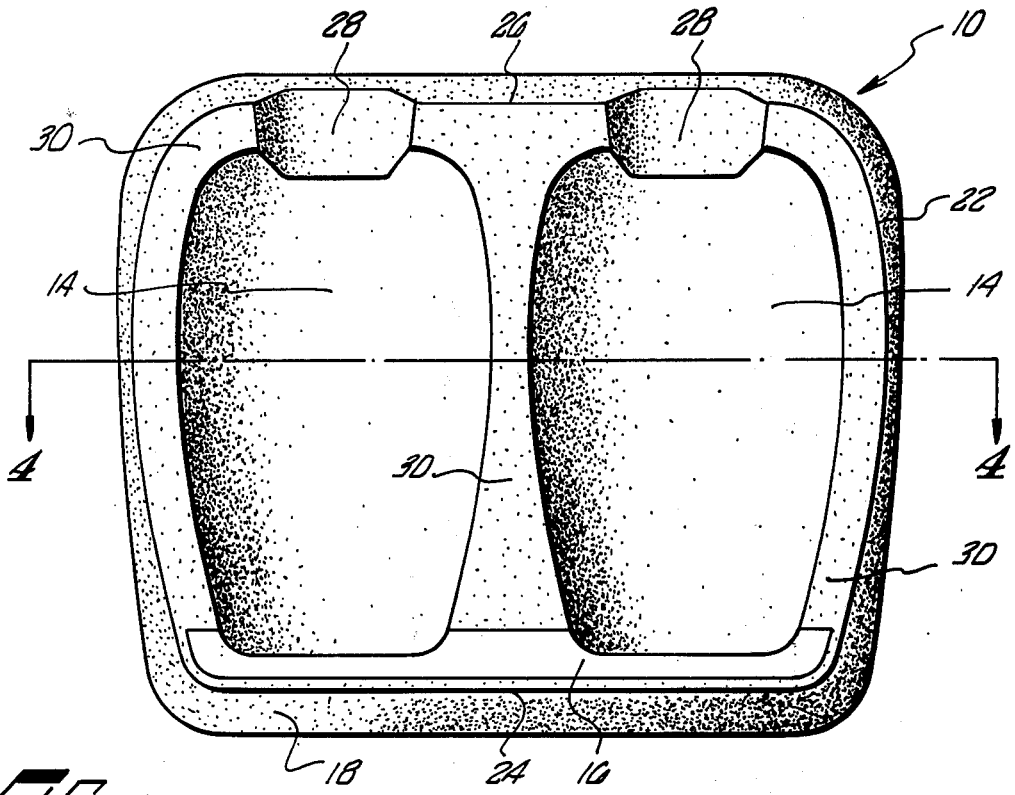
FIG. 1 is a plan view of the multi-purpose receptacle, embodying the characteristic features of the invention.
Figure 3:
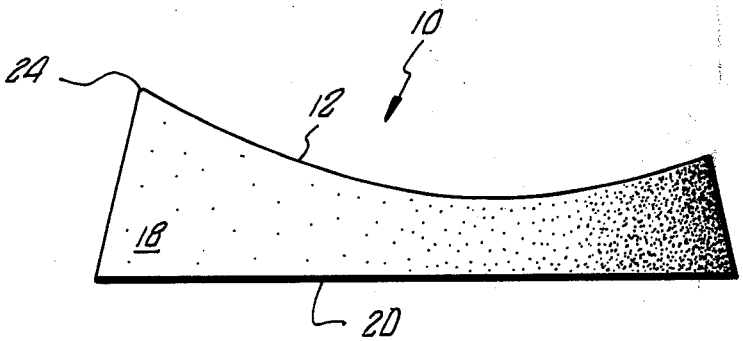
FIG. 3 is a side elevational view of the receptacle.

Referring now to FIGS. 1, 2 and 3, in which similar reference numerals indicate the same parts, the multi-purpose receptacle 10 may be seen to include a variety of surface areas to support, retain and restrain a variety of culinary implements. These areas include a curvilinear tray 12, elongated recesses 14 and a ledge 16. Each of these areas as will be more fully discussed hereinafter, can function in a multiplicity of ways to effectively retain a variety of implements. This is accomplished by the particular construction of each such area and its interrelationship with each other of those mentioned.

The multi-purpose receptacle 10 is basically formed by the curvilinear tray 12 and a supporting wall structure 18 that protrudes downwardly from such tray in a slightly angled manner. This wall terminates in a lower edge 20 which is of substantially planar nature and is adapted to rest on any suitable supporting surface 21, such as a stove, table or countertop. Furthermore, note that the peripheral edge 22 of the curvilinear tray 21 includes a substantially horizontal first portion 24 that resides above all other tray portions. Similarly, there is a second substantially horizontal portion 26 opposite portion 24, that is similarly formed by peripheral edge 22 and supporting wall 18 and which resides above some other portions of the curvilinear tray but not above portion 24. Accordingly, as can best be seen in FIG. 3, the tray 12 forms a cradle-like member that can be suitably employed to retain basting or similar type implements of an elongated and/or circular nature.

As is apparent, the receptacle 10, in its preferred form, includes a plurality [two] of recesses 14. These recesses are elongated in nature and extend transversely to the longitudinal axis of the curvilinear tray 12. Such as formed by the wall members 26 as can best be seen in FIGS. 4 and 5. These wall members are curved in a fashion similar to the tray 12 along the longitudinal axis thereof and similarly curve upwardly along each longitudinal edge to form a side wall portion of the recess.

The recesses 14 further include, as an integral part thereof, openings or slots 28 which extend from the front supporting wall portion 18 and peripheral edge 22 into the recess proper. These openings, or slots, 28 thereby provide a retentive means for spoon, fork or ladle handles, knives or the like. Furthermore, due to the curvilinear character of the recesses themselves, spoon bowls and similarly shaped items and even food products, such as eggs, are readily retained therein.

It should here also be pointed out that the substantially horizontal portions 24 and 26, of peripheral edge 22 and supporting wall structure 18, as well as the openings 28, are in such relationship that a typical knife 34 supported across same will pass through the opening 28 and thus will be retained by such opening. Furthermore, it should be noted that the recesses 14 are of such size and shape that they occupy most of the tray 12. Accordingly, the only existing curvilinear tray portion 12 that remains is formed by the narrow boundary areas 30 that circumscribe the recesses 14.

The last of the above-mentioned implement supporting areas, is the ledge 16. This ledge is positioned in the curvilinear tray surface 12 adjacent portion 24 of the peripheral edge 22 and supporting wall structure 18. Similarly, the ledge intersects or interengages the recesses 14 along the uppermost edges thereof. Accordingly, any drainage into the ledge area will find its way into recesses 14 thus preserving the integrity of the receptacle supporting surface 21. As is best seen in FIG. 6, the ledge 16 may usually be employed to support a spatula member 32 as is shown in phantom there. As was indicated hereinabove, the front back depth of receptacle member 10 and the respective heights of the first and second portions 24 and 26, make it possible for the user to support knife-like members 34 across these elements and into the slot 28 so that such will be firmly retained thereby. Likewise, when spoons 36, or other similar handled members, are supported within recesses 14, the handle portions thereof extend through the mentioned slots 28. The handle portions are thereby exposed for easy retrieval by the user. However, it may be readily appreciated that because of the low profile these handle portions are retained in an out-of-the-way position very close to the mentioned supporting surface 21 for receptacle 10. Accordingly, the user will be less likely to accidentally engage such thereby spilling the contents or dislodging the culinary implement from the holder receptacle 10.

Figure 4:
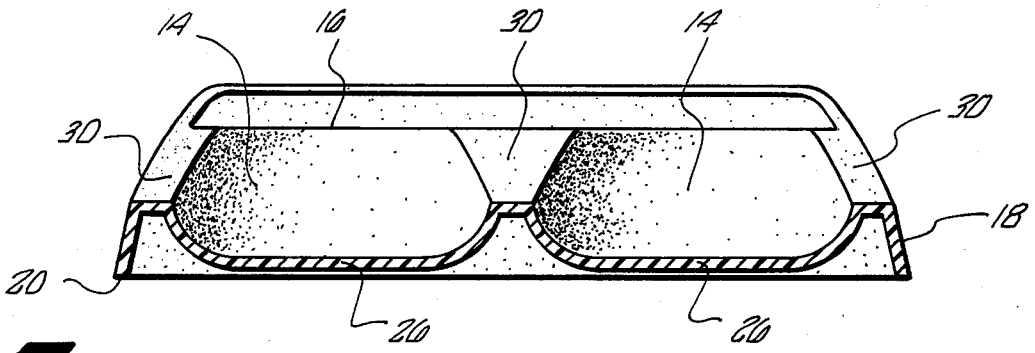
FIG. 4 is a cross-sectional view of the receptacle taken along line 4—4 of FIG. 1.

Although in the preferred embodiment, it is anticipated that the subject receptacle 10 will be molded from suitable plastic material, it should be understood that any other material might be used in the formation of such devices and that such may be made in solid form rather than cored as is illustrated in the various cross-sections of FIGS. 4 through 6.

I claim:

1. A multi-purpose receptacle particularly adapted to support, retain and restrain a variety of culinary implements used during meal preparation or service and comprising:

a curvilinear tray bounded at its peripheral edge by a supporting wall structure, said peripheral edge and supporting wall structure having a first portion that extends above all other portions thereof and a second portion that extends above some other portions thereof all along the peripheral edge of the supporting wall structure opposite that of said first portion, said curvilinear tray having therein at least one elongated recess and a ledge adjacent one end of such recess having a continuous back wall portion formed by said supporting wall structure, said ledge in like fashion being adjacent the first portion of said peripheral edge and supporting wall structure and, at least one opening in the second portion of said peripheral edge and supporting wall structure that extends to said recess.

2. A multi-purpose receptacle particularly adapted to support, retain and restrain a variety of culinary implements used during meal preparation or service and comprising:

a curvilinear tray bounded at its peripheral edge by a supporting wall structure, said peripheral edge and supporting wall structure having a first portion that extends above all other portions thereof and a second portion that extends above some other portions thereof, said curvilinear tray having therein a plurality of elongated recesses and a ledge adjacent one end of such recesses said ledge in like fashion being adjacent the first portion of said peripheral edge and supporting wall structure with a portion thereof forming a continuous back wall for the ledge, and a plurality of openings in the second portion of said peripheral edge and supporting wall structure each extending to one of said recesses.

3. A multi-purpose receptacle particularly adapted to support, retain and restrain a variety of culinary implements used during meal preparation or service and comprising:

a curvilinear tray having a peripheral edge with a downwardly directed supporting wall structure emanating from said edge, said peripheral edge and supporting wall structure having a first substantially continuous horizontal portion that extends above all other portions thereof and a second substantially horizontal portion that extends above some other portions thereof, said curvilinear tray including a plurality of elongated recess positioned in transverse relationship thereto and of such size that said curvilinear tray is formed only by narrow boundary areas extending around the recesses, and a plurality of openings in the second portion of said peripheral edge and supporting wall structure that communicate with said recesses.

4. A multi-purpose receptacle according to claim 3 wherein said curvilinear tray also incorporates additional means adjacent the first portion of said peripheral edge and supporting wall structure adapted to support and retain a food service implement in a position above said curvilinear tray.

5. A multi-purpose receptacle according to claim 4 wherein in said means at least partially intersects said recesses thereby providing a convenient passage for drainage of foodstuff from the supported implement into the recesses.

6. A multi-purpose receptacle according to claim 3 wherein said recesses are positioned transversely of the tray and are of such size that said tray is formed only by narrow boundry areas extending around the recesses.

* * * * *